US005638649A

United States Patent [19]

Hovland

[11] Patent Number: 5,638,649

[45] Date of Patent: Jun. 17, 1997

[54] FULL CORNER LOG SIDING AND METHOD FOR USING SAME

[76] Inventor: Keith Hovland, 3289 Cedar Island Dr., Eveleth, Minn. 55734

[21] Appl. No.: 586,398

[22] Filed: Jan. 16, 1996

[51] Int. Cl.[6] ..... E04B 2/02

[52] U.S. Cl. ..... 52/233; 52/272; 52/311.2; 52/554; 52/748.11

[58] Field of Search ..... 52/233, 286, 272, 52/311.1, 311.2, 313, 554, 592.6, 748.11; 446/106

[56] References Cited

U.S. PATENT DOCUMENTS

| | | | |
|---|---|---|---|
| 2,021,341 | 11/1935 | Ward . | |
| 2,040,110 | 5/1936 | Tahvonen et al. | 52/592.6 |
| 3,863,409 | 2/1975 | Fell | 52/233 |
| 4,056,906 | 11/1977 | Elfstrom . | |
| 4,096,674 | 6/1978 | Kollar et al. . | |
| 4,320,610 | 3/1982 | Rupp . | |
| 4,330,973 | 5/1982 | Marklund et al. . | |
| 4,429,500 | 2/1984 | Farmont . | |
| 4,503,647 | 3/1985 | Post . | |
| 4,592,182 | 6/1986 | Felser . | |
| 4,627,204 | 12/1986 | Smith . | |
| 4,640,069 | 2/1987 | Felser . | |
| 4,649,683 | 3/1987 | Dolata | 52/233 |
| 4,878,328 | 11/1989 | Berge . | |
| 4,901,489 | 2/1990 | Garber | 52/233 |
| 5,010,701 | 4/1991 | Halsey, Jr. et al. . | |
| 5,271,878 | 12/1993 | Mizia et al. . | |

FOREIGN PATENT DOCUMENTS

| | | | |
|---|---|---|---|
| 221644 | 9/1991 | Japan | 52/233 |

*Primary Examiner*—Michael Safavi

[57] ABSTRACT

Log siding for an existing structure to give the appearance of traditional full log construction. The corner pieces are preformed in two cooperating shapes to fit snugly together at the corners of the structure. One type of corner piece has three perpendicular planes at its inner end, to abut against the corner of the structure. The second corner piece has concave arcs at its inner end, to fit snugly against the rounded surfaces of the first corner pieces. The siding pieces are square cut at one end of each wall to fit against the end of the first type of corner piece and are cut in concave arcs at the opposite end of each wall to fit snugly against the rounded shapes of the logs at the corner. The siding can be speedily erected at the site with a minimum of field cutting.

4 Claims, 6 Drawing Sheets

FULL CORNER LOG SIDING AND METHOD FOR USING SAME

BACKGROUND

Log cabins utilize a primitive form of construction which has been used by persons in this and foreign countries for many years. Some of the drawbacks to current use of traditional log cabin construction are the expense and difficulty of obtaining logs of uniform size, the difficulty of insulating the structure, and the lack of room within the walls for electrical wiring. Nevertheless there is a continuing public desire for buildings having the appearance of traditional log cabins. As a result of these shortcomings, there is a need for means and methods of creating structures which, while having conventional building construction, create the desired appearance of log cabins.

Earlier designs have attempted to give the appearance of log cabin construction while not using full logs. However, these earlier designs have resorted either to partial corner construction or to complex end-piece configuration to accomplish the desired result. The partial corner construction of the prior art does not give a realistic appearance of traditional mortise log cabin construction. Further, the complex end-piece configurations of the prior art is much more complex to manufacture and is not readily adapted to speedy field construction with a minimum of tools. Thus there is a need for full corner log siding in which all pieces can be pre-formed, leaving only straight saw cuts to be made in the field.

My invention is directed to the use of wood products to fabricate log siding and corner pieces which are used in cooperation with each other to make any new or existing construction look exactly as if it has been built as traditional mortise log cabin construction.

This invention provides partial-log-shaped wood siding which can be made from standard rough cut material such as 2-inch or 3-inch boards, thus being cost competitive with other standard sidings. The use of standard rough cut material substantially reduces waste and cost. The corner pieces of this invention are pre-cut from full logs; half of the corner pieces are cut as tabbed corner pieces and half of them are cut as pointed corner pieces. The siding is erected from prefabricated pieces cut to shape to abut against the shape of the prefabricated corner pieces. No cutting tools beyond a standard circular saw are needed in the field.

My invention also provides corners of full log construction which give the entire structure a look identical to that of a traditional log cabin. The corners are constructed of prefabricated pieces which fit together without adjustment in the field. Additionally, the corner pieces are small enough that they can easily be kiln dried prior to use, thus eliminating future shrinkage and preventing the formation of gaps which require caulking.

My invention can be used on any new or existing building which has an adequate roof overhang. It provides the look of traditional log construction at greatly reduced cost; the reduced weight of this full corner log siding also reduces the costs of shipping from the factory to the building site.

My full corner log siding provides log siding and corner pieces cooperating with the siding for use on a typical structure having a foundation and four or more walls, where the walls meet perpendicularly at four or more intersecting corners, and the four or more walls rest on the foundation. The log siding is comprised of rows, a first row to abut the foundation and additional rows to extend upward therefrom. Each of the rows has one straight end and one fitted end. Each of the rows has one or more pieces.

Each of the row pieces is formed as a cylindrical segment of a pre-determined radius having width, a height, a length, a top extension, a bottom recess, an inner face along the chord of the cylindrical segment, and an imaginary center plane along the length of the piece and perpendicular to the inner face. The inner face of each piece is made to abut and be fastened to one of the four or more walls, the bottom recess of each piece of the first row to abut the foundation of the structure, and the bottom recess of each piece of every row other than the first row to overlap the top extension of the next lower piece. The straight end of each row is a piece with ends substantially perpendicular to the length of the piece.

The fitted end of each row is a piece having an inner end and a pointed end; the inner end is a surface perpendicular to the length of the piece, and the pointed end comprises two concave cylindrical surfaces, an upper concave cylindrical surface and a lower concave cylindrical surface, the radius of each of said upper and lower concave cylindrical surfaces being equal to the radius of the piece, with each of the upper and lower concave cylindrical surfaces having a height of half the height of the piece and a maximum width of the width of the piece, and with the upper concave cylindrical surface being perpendicular to the top of the cylindrical segment and the lower concave cylindrical surface being perpendicular to the bottom of the cylindrical segment; the upper and lower concave cylindrical surfaces form an apex at the imaginary center plane of the piece. Each of the fitted end pieces is made to abut and be fastened to one of the four or more walls.

Each of the corner pieces is a substantially cylindrical log of the same radius as that of the siding pieces, having an imaginary center plane along its length, said imaginary center plane being substantially horizontal, and having a top plane along a chord of the log at a distance of half the height of the siding pieces above the imaginary center plane, the top plane being substantially horizontal and having a length parallel to the length of the corner piece and having a width perpendicular to the length of the corner piece, and having a bottom plane parallel to the top plane at a distance of half the height of the siding pieces below the imaginary center plane, the bottom plane being substantially horizontal and having a length parallel to the length of the corner piece and having a width perpendicular to the length of the corner piece.

The bottom plane of the first corner piece is made to abut the foundation of the structure and the bottom plane of each corner piece other than the first corner piece is made to abut the top plane of the next lower corner piece.

Each of the corner pieces is made to extend outwardly from one of the four or more intersecting corners of the structure in either a first direction or a second direction, the first direction to extend the line of one of the walls and the second direction to be perpendicular to the first direction.

The corner pieces are either tabbed corner pieces or pointed corner pieces. Each of the tabbed corner pieces has a top plane, a bottom plane, a distal face, an inner end, a length between the distal face and the inner end, an exterior convex surface to form a 180-degree angle with an adjacent wall, and an interior convex surface to form a 90-degree angle with a second, adjacent, wall. The distal face is substantially perpendicular to the length of the tabbed corner piece. The inner end has three planes, a first plane, a second plane, and a third plane; the first plane is perpendicular to the length of the tabbed corner piece and is a circular segment of the same radius as that of the siding pieces, having width equal to that of the siding pieces, and having height equal to the height of the siding pieces; the second plane is a rectangle perpendicular to the first plane and has a width equal to the height of the siding pieces and a length less than the width of the top and bottom planes of the adjacent pointed corner pieces; and the third plane is perpendicular to the second plane. The distance between the distal face and the first plane of the inner end is greater than the distance between the distal face and the third plane of the inner end.

The interior convex surface of the tabbed corner piece is made to abut the upper concave cylindrical surface of the fitted end of one row and the lower concave cylindrical surface of the fitted end of the next higher row. The first plane of the inner end of the tabbed corner piece is made to abut the straight end of one row, the second plane of the inner end of the tabbed corner piece is made to abut one of the four or more walls at one of the four or more intersecting corners, the tabbed corner piece can be fastened to the first wall through the second plane, and the third plane of the inner end of the tabbed corner piece is made to abut the wall which intersects the one wall at that intersecting corner and the tabbed corner piece can be fastened to said intersecting wall through the third plane.

Each of the pointed corner pieces has a top plane, a bottom plane, a distal face, a pointed end, a length between the distal face and the pointed end, an exterior convex surface to form a 180-degree angle with an adjacent wall, and an interior convex surface to form a 90-degree angle with an adjacent wall. The distal face is substantially perpendicular to the length of the pointed corner piece. The pointed end comprises two concave cylindrical surfaces, an upper concave cylindrical surface and a lower concave cylindrical surface; the radius of each of the upper and lower concave cylindrical surfaces is equal to the radius of the pointed corner piece; each of the upper and lower concave cylindrical surfaces has a height equal to half the height of the siding pieces and a maximum width equal to the width of the pointed corner piece; the upper concave cylindrical surface is perpendicular to the top plane of the pointed corner piece, the lower concave cylindrical surface is perpendicular to the bottom plane of the pointed corner piece, the upper and lower concave cylindrical surfaces form an apex at the imaginary center plane of the pointed corner piece, and the lower concave cylindrical surface is made to abut the exterior convex surface of one of the tabbed corner pieces and its adjacent straight end piece and the upper concave cylindrical surface is made to abut the exterior convex surface of the next higher tabbed corner piece and its adjacent straight end piece, and the pointed corner piece can be fastened to the adjacent tabbed corner pieces and straight end pieces. The exterior convex surface of each of the pointed corner pieces extends the outer circumferential surface of a previously placed siding piece.

These and other features, aspects, and advantages of the invention will be become better understood with regard to the following description, appended claims, and accompanying drawings.

BRIEF DESCRIPTION OF THE DRAWINGS

The invention will be further described in connection with the accompanying drawings, in which.

DESCRIPTION

Elements of the Invention

Figure 1:
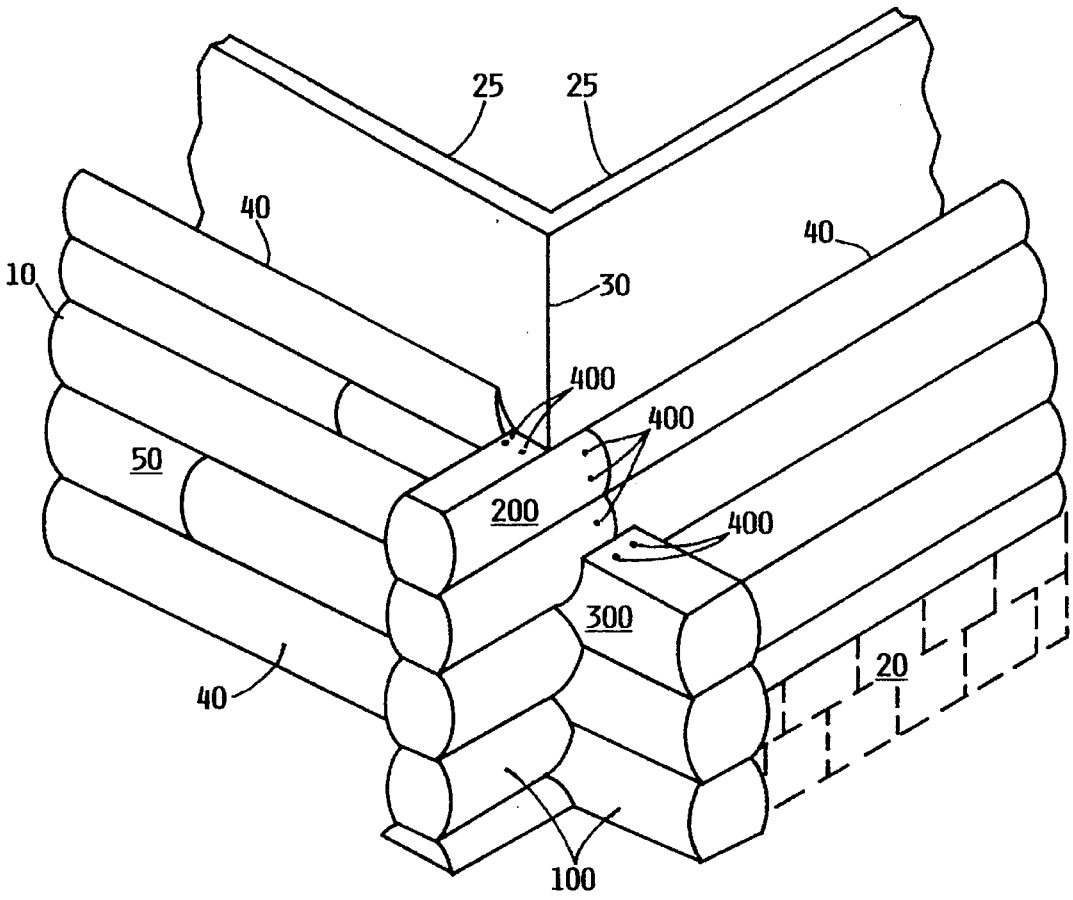
FIG. 1 is a perspective view of the log siding and cooperating corner pieces of the full corner log siding of a version of the invention.

Referring now to the drawings, wherein like reference numerals designate like or corresponding parts throughout the several views, FIG. 1 illustrates a preferred embodiment of the invention.

As shown in FIG. 1, my full corner log siding 10 can be used on a structure having a foundation 20 and walls 25 with intersecting corners 30. The log siding comprises pieces 40 which cooperate to form rows 50. The corner pieces 100 cooperate with the log siding 10 to create my full corner log siding. As shown in FIG. 1, the corner pieces 100 are comprised of tabbed corner pieces 200 and pointed corner pieces 300. The tabbed corner pieces 200 can be fastened to wall 25 by fasteners 400. Fasteners 400 are six point finishing screws with recessed heads or any other suitable fasteners such as nails, pins, pegs, or glue. The number of fasteners 400 needed will vary in relation to the size of the log siding used, and will be apparent to those skilled in the art.

Figure 2:
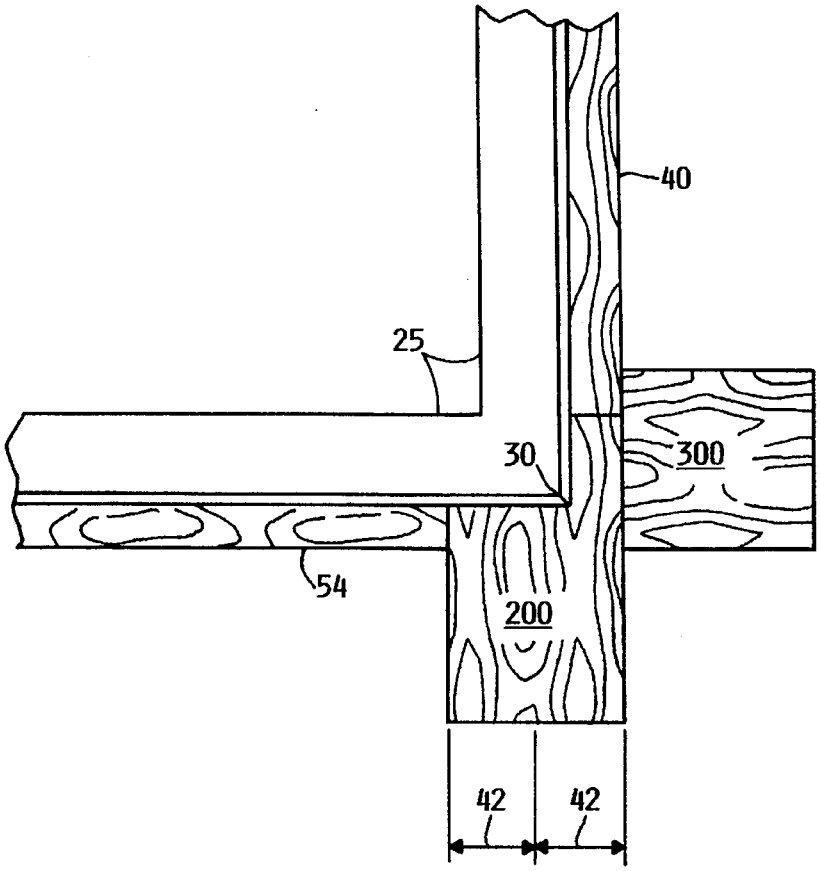
FIG. 2 is a partial plan view of the log siding and cooperating corner pieces of FIG. 1.

My full corner log siding can be used with standard wall construction as shown in FIG. 2. As shown in FIG. 2, straight end piece 40 of row 50 is made to abut interior convex surface of tabbed corner piece 200. FIG. 2 also shows that the tabbed corner pieces 200 are made to enclose the intersecting corner 30, and the pointed corner pieces 300 are made to abut the exterior convex surfaces of tabbed corner piece 200 and straight end piece 40.

Figure 3:
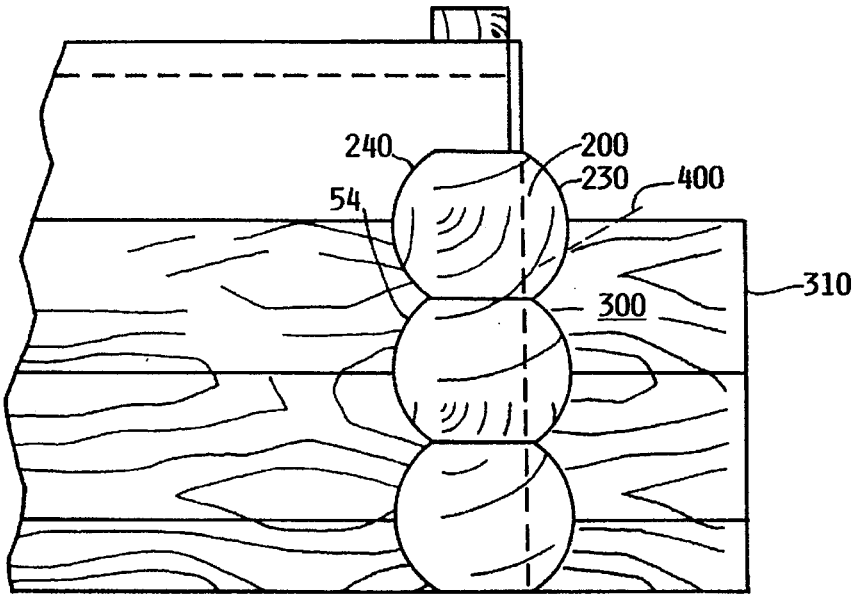
FIG. 3 is an elevation view of the log siding and cooperating corner pieces of FIG. 1.

As shown in FIG. 3, the fitted ends 54 of rows 50 are shaped to conform to the interior convex surfaces 240 of tabbed corner pieces 200, and the faces of pointed corner pieces 300 are shaped to conform to the exterior convex surfaces 230 of tabbed corner pieces 200. Fasteners 400 are shown attaching pointed corner piece 300 to tabbed corner piece 200 and to straight end piece 40.

Figure 4:
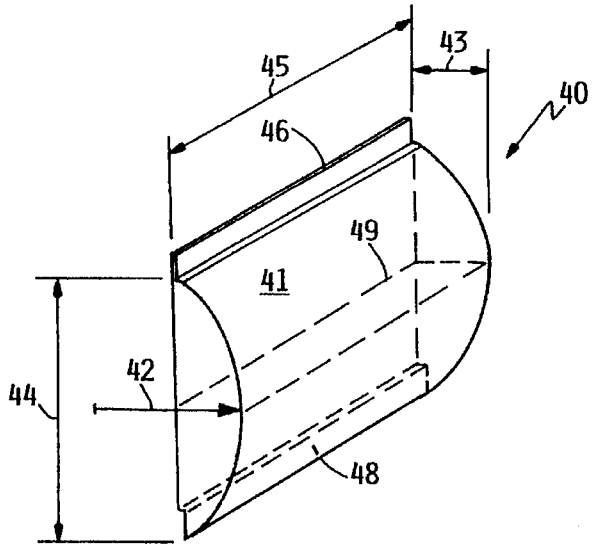
FIG. 4 is a perspective view of a typical siding piece of the log siding shown in FIG. 1.

FIG. 4 depicts a typical siding piece 40, comprised of a cylindrical segment of pre-determined radius 42, width 43, height 44, and length 45. The siding pieces 40 can be economically produced using standard 2-inch or 3-inch thick lumber such as 2×6 or 3×8. The siding pieces 40 have a top extension 46, a bottom recess 48, an inner face 41 along the chord of the cylindrical segment, and an imaginary center plane 49 along the length 45 and perpendicular to the inner face 41.

When siding piece 40 is installed on wall 25, the bottom recess 48 of the first siding piece 40 abuts the foundation of the structure and the bottom recess 48 of each siding piece 40 other than the first siding piece is fitted over the top extension 46 of the next lower piece to create an overlapping joint. Every reference to siding piece 40 is also applicable to fitted end piece 54.

One end of each row 50 is comprised of a fitted end piece 54 which is preformed to abut against the outer circumference of the tabbed corner piece 200.

Figure 5:
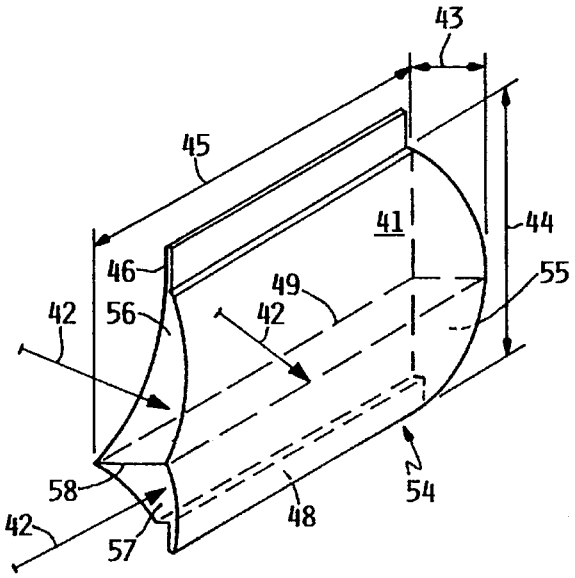
FIG. 5 is a perspective view of a piece at the fitted end of a row of the log siding shown in FIG. 1.

FIG. 5 depicts a typical fitted end piece 54. Each of the fitted end pieces 54 is comprised of a cylindrical segment of radius 42, having width 43, height 44, and length 45. The radius 42 of the fitted end pieces 54 is equal to the radius 42 of the siding pieces 40. Each of the fitted end pieces 54 has an inner end 55 and a pointed end. The pointed end is comprised of an upper concave cylindrical surface 56 and a lower concave cylindrical surface 57, wherein each of the upper and lower concave cylindrical surfaces 56 and 57 has a radius 42 equal to the radius 42 of the siding pieces 40, a height of half the height 44 of the siding pieces 40, and a maximum width equal to the width 43 of the siding pieces 40. The upper concave cylindrical surface 56 is perpendicular to the top of the cylindrical segment, the lower concave cylindrical surface 57 is perpendicular to the bottom of the cylindrical segment, and the upper and lower concave cylindrical surfaces 56 and 57 form an apex 58 at the imaginary center plane 49 of the fitted end piece 54. When fitted end piece 54 is installed on wall 25, bottom recess 48 of the first fitted end piece 54 abuts the foundation 20 of the structure and bottom recess 48 of each fitted end piece 54 other than the first one is fitted over top extension 46 of the next lower piece to create an overlapping joint. Each of the fitted end pieces 54 is made to abut and be fastened to one of the four or more walls 25.

Figure 6:
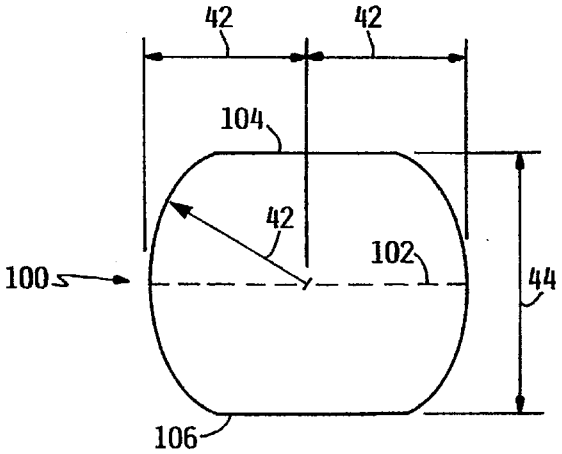
FIG. 6 is an elevation view of the end of one of the corner pieces shown in FIG. 1.

As shown in FIG. 6, each of the corner pieces 100 is a substantially cylindrical log of radius 42. The radius 42 of the corner pieces is equal to the radius 42 of the siding pieces 40. The corner pieces 100 are preferably formed from wood logs. The corner pieces of the first version of my invention have a substantially horizontal top plane 104 along a chord of the substantially cylindrical log. The top plane 104 has a length parallel to the centerline of the corner piece and a width perpendicular to the length. The top plane 104 lies at a distance of one-half the height 44 of the siding pieces 40 and 54 above an imaginary center plane 102. The imaginary center plane 102 is substantially horizontal and passes through the centerline of the corner piece. The corner pieces also have bottom plane 106 parallel to the top plane 104 and at a distance of one-half the height 44 below the imaginary center plane 102. The bottom plane 106 has a length parallel to the centerline of the corner piece and a width perpendicular to the length. Every reference to corner piece 100 is equally applicable to tabbed corner pieces 200 and pointed corner pieces 300.

The bottom plane 106 of the first corner piece 100 is made to abut against the foundation 20 of the structure and the bottom plane 106 of each corner piece 100 other than the first corner piece is made to abut the top plane 104 of the next lower corner piece.

Figure 7:
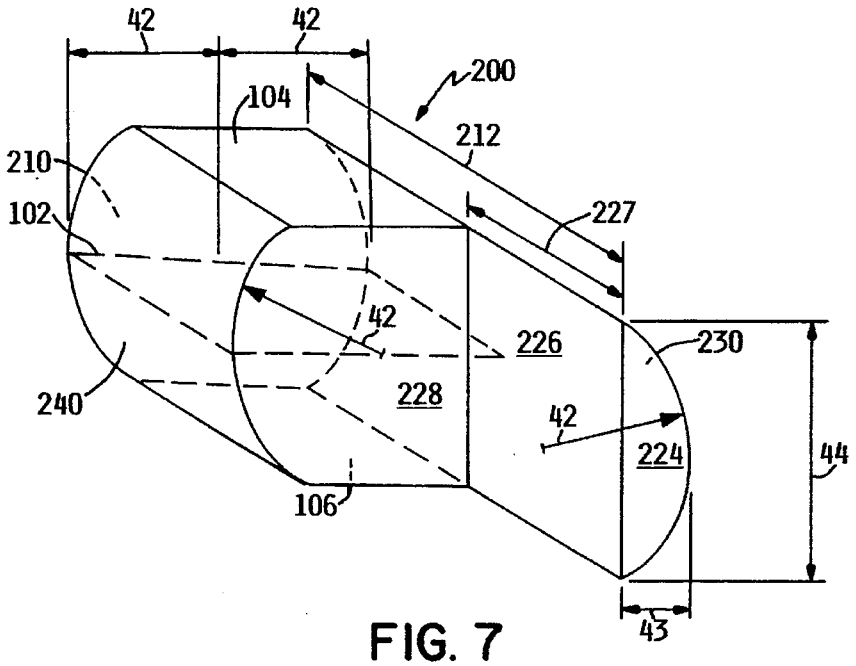
FIG. 7 is a perspective view of one of the tabbed corner pieces shown in FIG. 1.

The corner pieces which are made to abut the intersecting corners 30 of the structure are tabbed corner pieces 200. A typical tabbed corner piece 200 is shown in FIG. 7. Each of the tabbed corner pieces 200 has a top plane 104, a bottom plane 106, a distal face 210, an inner end, a length 212 between the distal face and the inner end, an exterior convex surface 230, and an interior convex surface 240. The top plane 104 and the bottom plane 106 are substantially horizontal. The interior convex surface 240 is that which will form a 90-degree angle with adjacent wall 25 when the log siding is installed; the exterior convex surface 230 is that which will form a 180-degree angle with adjacent wall 25 when the log siding is installed. The distal face 210 is substantially perpendicular to the length 212 of the tabbed corner piece 200. The inner end has three planes, a first plane 224, a second plane 226, and a third plane 228. The first plane 224 is perpendicular to the length 212 of the tabbed corner piece 200 and is a circular segment of the same radius 42 as that of the siding pieces 40, having width 43 equal to that of the siding pieces 40, and height 44 equal to the height 44 of the siding pieces 40. The second plane 226 is a rectangle perpendicular to the first plane 224 which has a width 44 equal to the height 44 of the siding pieces and a length 227 less than the width of the top plane 104 and less than the width of the bottom plane 106 of the adjacent pointed corner pieces 300. The third plane 228 is perpendicular to the second plane 226. The length 212 between the distal face 210 and the first plane 224 of the inner end is greater than the distance between the distal face 210 and the third plane 228 of the inner end.

The interior convex surface 240 of the tabbed corner piece 200 is made to abut the upper concave cylindrical surface 56 of the fitted end 54 of one row 50 and the lower concave cylindrical surface 57 of the fitted end 54 of the next higher row 50. The first plane 224 of the inner end of the tabbed corner piece 200 is made to abut the end of one row 50, the second plane 226 of the inner end of the tabbed corner piece 200 is made to abut one of the four or more walls 25 at one of the four or more intersecting corners 30, the tabbed corner piece 200 can be fastened to the wall 25 through the second plane with fasteners 400, and the third plane 228 of the inner end of the tabbed corner piece 200 is made to abut the wall 25 which intersects the first wall 25 at that intersecting corner 30 and can also be fastened to said intersecting wall 25 with fasteners 400.

Figure 8:
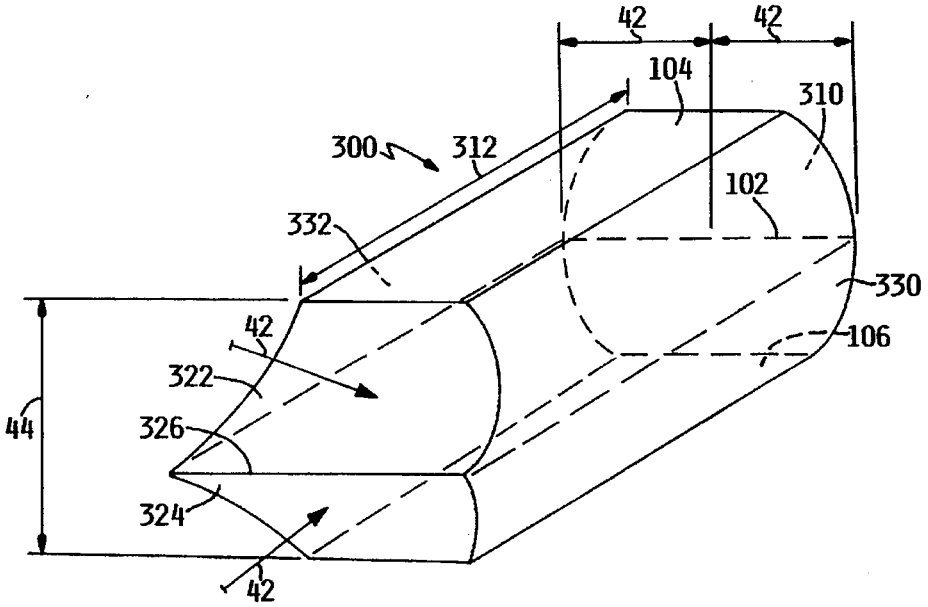
FIG. 8 is a perspective view of one of the pointed corner pieces shown in FIG. 1.

The pointed corner pieces 300 complete the full corner of my invention. A typical pointed corner piece 300 is shown in FIG. 8. Each of the pointed corner pieces 300 has a top plane 104, a bottom plane 106, a distal face 310, a pointed end, a length 312 between the distal face 310 and the pointed end, an exterior convex surface 330, and an interior convex surface 332. The interior convex surface 332 is that which will form a 90-degree angle with adjacent wall 25; the exterior convex surface 330 will extend the outer circumferential surface of a previously placed siding piece 40 on an intersecting wall 25, as shown in FIG. 1.

The distal face 310 is substantially perpendicular to the length 312 of the pointed corner piece 300. The pointed end is formed of two concave cylindrical surfaces, an upper concave cylindrical surface 322 and a lower concave cylindrical surface 324; the radius 42 of each of the upper and lower concave cylindrical surfaces 322 and 324 is equal to the radius 42 of the pointed corner piece 300; each of the upper and lower concave cylindrical surfaces 322 and 324 has a height equal to half the height 44 of the siding pieces 40 and a maximum width equal to the width of the imaginary center plane 102 of the pointed corner pieces 300; the upper concave cylindrical surface 322 is perpendicular to the top plane 104 of the pointed corner piece 300, the lower concave cylindrical surface 324 is perpendicular to the bottom plane 106 of the pointed corner piece, and the upper and lower concave cylindrical surfaces 322 and 324 form an apex 326 at the imaginary center plane 102 of the pointed corner piece 300. The lower concave cylindrical surface 324 is made to abut the exterior convex surface 230 of one of the tabbed corner pieces 200 and the upper concave cylindrical surface 322 is made to abut the exterior convex surface 230 of the next higher tabbed corner piece 200. The pointed corner piece 300 can be fastened to the adjacent tabbed corner piece 200 and siding piece 40 by fasteners 400.

Figure 9:
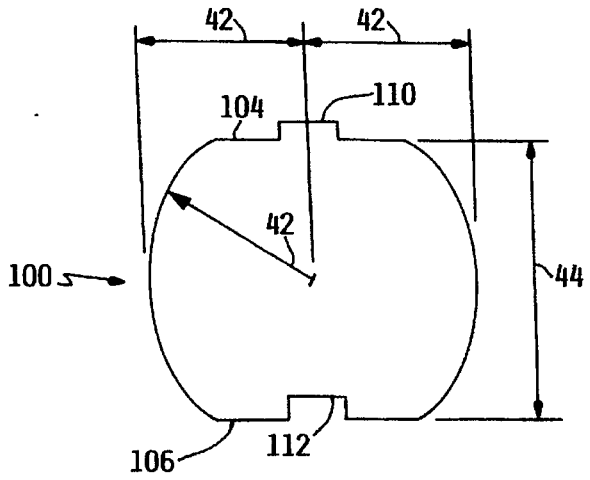
FIG. 9 is an elevation view of the end of a corner piece of an alternate embodiment of the invention using one spline and groove.
Figure 10:
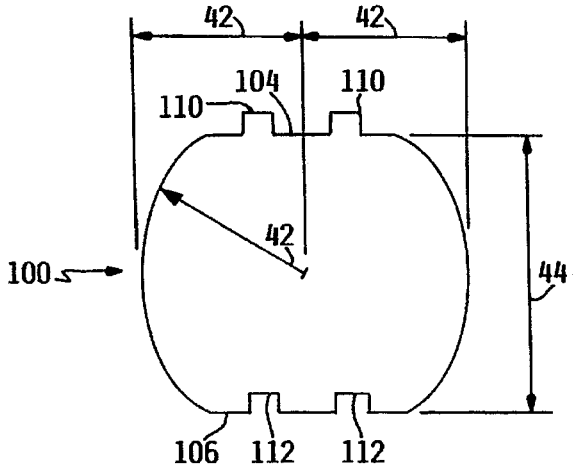
FIG. 10 is an elevation view of the end of a corner piece of an alternate embodiment of the invention using two splines and grooves.
Figure 11:
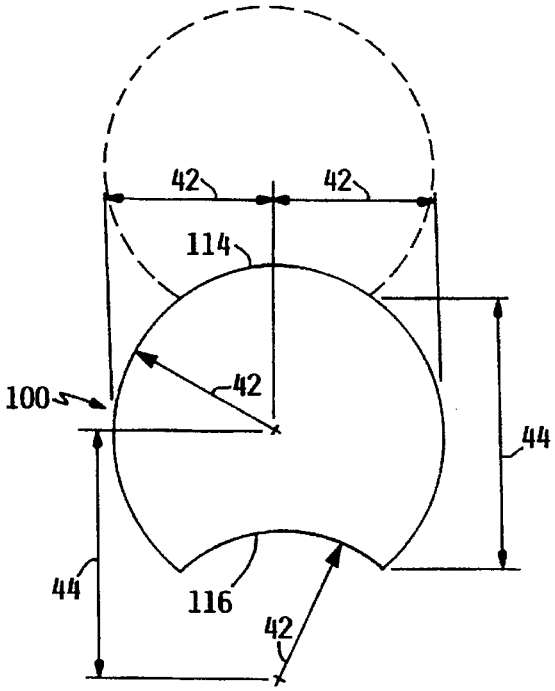
FIG. 11 is an elevation view of the end of a corner piece of an alternate embodiment of the invention using circular tops and recessed bottom surfaces.
Figure 12:
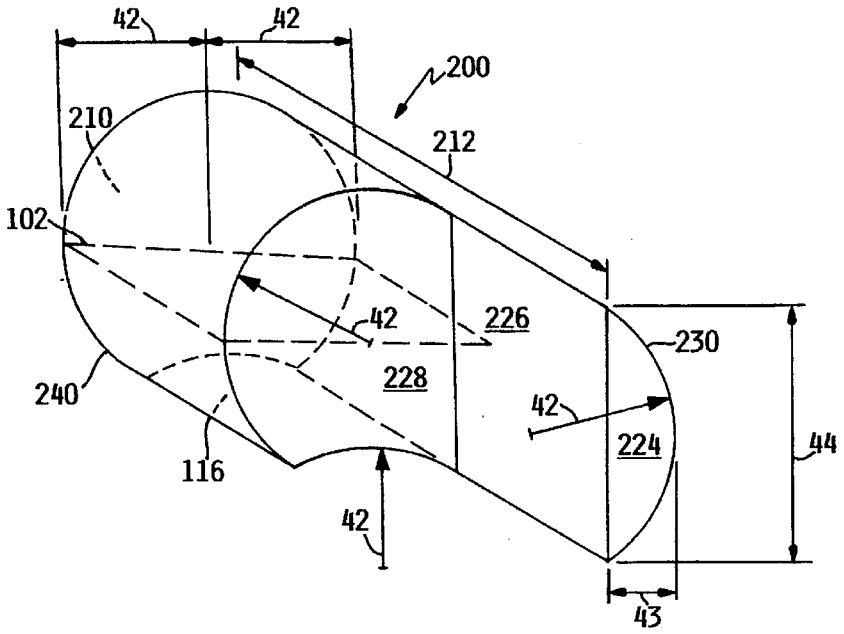
FIG. 12 is a perspective view of a tabbed corner piece in an alternate embodiment of the invention using circular tops and recessed bottom surfaces.
Figure 13:
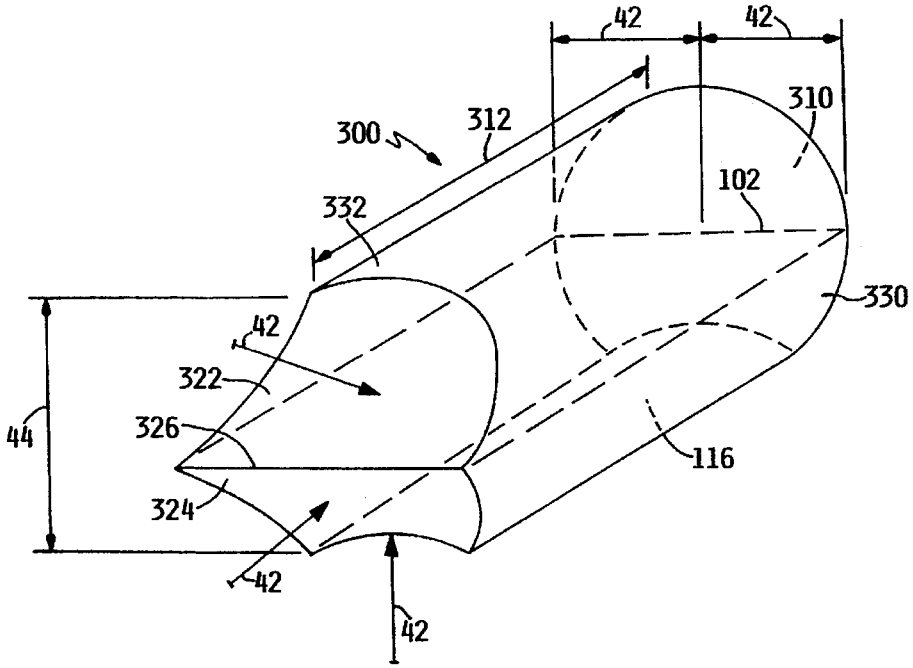
FIG. 13 is a perspective view of a pointed corner piece in an alternate embodiment of the invention using circular tops and recessed bottom surfaces.

Alternate embodiments of the corner pieces 100 of my invention are shown in FIGS. 9, 10, and 11. FIG. 9 depicts the use of a spline 110 extending upward from the top plane 104 and running the length of the top plane, and the use of a matching groove 112 extending inward from the bottom plane 106 and running the length of the bottom plane. The spline 110 is made of any convenient shape and size which will fit into the groove 112 to facilitate accurate placement of the corner pieces 100. Two or more splines 110 and grooves 112 may be used, as shown in FIG. 10. When two or more splines and grooves are used, the grooves 112 conform to the spacing, size and shape of the splines 110.

FIG. 11 depicts an alternate embodiment of the corner pieces 100 in which a convex cylindrical top surface 114 replaces the top plane 104 and a convex cylindrical bottom surface 116 replaces the bottom plane 106. Convex cylindrical top surface 114 is a continuation of the circumference of the substantially cylindrical log. Concave cylindrical bottom surface 116 has a radius 42, the same radius as that of the corner piece 100, the centerline of said concave cylindrical surface located along a plane which lies parallel to and at the height 44 of a siding piece 40 below the imaginary center plane 102 of the corner piece 100, as shown in FIG. 11.

The siding pieces 40, the fitted end pieces 54, the tabbed corner pieces 200, and the pointed corner pieces 300 are prefabricated away from the building site. If the first version of my invention is used, each of the components other than the fitted end pieces 54 can be used for either right-hand or left-hand construction, right-hand construction being designated as that in which the fitted end pieces 54 are placed at the right end of each row 50 on each wall 25. Right-hand construction is shown in FIG. 1. Fitted end pieces 54 can be prefabricated for right-hand construction so that each of them has its upper and lower concave cylindrical surfaces 56 and 57 at the right end of the piece when the top extension 46 is at the top of the piece.

If alternate embodiment corner pieces 100 are used, they can be prefabricated in either right-hand or left-hand construction according to the above nomenclature. Any one construction project will use only one method of construction, either right-hand or left-hand. Economy can be realized by prefabricating all pieces to fit one or the other of the construction directions; I have fabricated components for right-hand construction but left-hand construction would work equally well.

Although 2×6 and 3×8 lumber has been suggested as the basis for fabrication of siding pieces 40, it is recognized that many other sizes of lumber would also meet the requirements of my invention; the siding can be made to simulate nearly any dimension round log. The corner pieces 100 of my invention will be small enough so that they can easily be kiln dried prior to use, thus eliminating shrinkage after construction and preventing the formation of gaps which would require caulking.

Erection of the siding at the site requires the use of only a saw to make straight cuts and means such as screws, nails, pins, pegs, or glue to fasten the siding and corner pieces to the structure.

Use of the Invention

In erecting the siding of this invention, the builder will follow these steps. A first tabbed corner piece 200 is placed at the foundation 20 of a first wall 25 at a first intersecting corner 30 with a second wall 25 and fastened to the walls 25 by the use of fasteners 400 passing through the second plane 226 and through the third plane 228 of the tabbed corner piece 200. Next, a tabbed corner piece 200 is split longitudinally; one of the split tabbed corner pieces is then placed at the foundation 20 of the second wall 25 at a second intersecting corner 30 with a third wall 25 and fastened to both walls 25 by the use of fasteners 400 passing through the second plane 226 and the third plane 228 of the split tabbed corner piece 200.

Then another first tabbed corner piece 200 is placed at the foundation 20 of the third wall 25 at the third intersecting corner 30 with a fourth wall 25 and fastened to the walls 25 with fasteners 400; then another tabbed corner piece 200 is split longitudinally, and one of the split tabbed corner pieces is placed at the foundation 20 of the fourth wall 25 at the fourth intersecting corner 30 with the first wall 25, and is fastened to the walls 25 with fasteners 400. If there are additional walls and intersecting corners, first tabbed corner pieces 200 are fastened to the walls 25 at the intersecting corners 30 as above until there is one tabbed corner piece 200 at the foundation 20 of each intersecting corner 30.

Then tabbed corner pieces 200 are stacked on top of the first tabbed corner piece at each intersecting corner until the stacked tabbed corner pieces 200 reach the top of each wall; each tabbed corner piece 200 is fastened to each wall 25 with fasteners 400.

Next, the siding pieces are installed on the first wall. The siding can either be installed from the top down, or from the bottom up. Horizontal siding, where an overlap is involved as illustrated here, is generally installed from the botom up; this method will be described here. The first row 50 of siding is installed by first placing a fitted end piece 54 adjacent to and abutting the foundation of the first wall 25 and adjacent to the first tabbed corner pieces 200 so that the apex 58 of the fitted end piece 54 meets the junction between the first tabbed corner piece 200 and the next highest tabbed corner piece 200. Then the first row 50 is completed by placing pieces 40 adjacent to and abutting the foundation of the wall 25 to fill the space between the straight end of the fitted end piece 54 and the first plane 224 of the inner end of the tabbed corner piece 200 at the next intersecting corner 30. Each of the pieces 40 and 54 is fastened to the wall 25 by fasteners 400.

Then the second row 50 of siding is installed on the first wall 25 by fitting the bottom recesses 48 of the upper pieces over the top extensions 46 of the first row pieces and following the procedure used for installing the first row, and all remaining rows 50 are installed by continuing as for the second row. Each of the pieces 40 and 54 is fastened to the wall 25 by fasteners 400.

Then the siding is installed on the second wall 25. To make the first row 50, a fitted end piece 54 is split longitudinally and one of the split pieces is placed adjacent to and abutting the foundation 20 of the wall 25, and adjacent to the first tabbed corner piece 200 so that the apex 58 of the fitted end piece 54 meets the junction between the first tabbed corner piece and the foundation 20. Then the first row 50 is completed by splitting straight end pieces 40 and placing them adjacent to and abutting the foundation 20 of the second wall 25 to fill the length between the straight end of the fitted end piece 54 and the first plane 224 of the inner end of the tabbed corner piece 200 at the next intersecting corner 30. Each of the split pieces 40 and 54 is fastened to the wall 25 by fasteners 400.

Then the second row 50 of siding is installed on the second wall 25 by fitting the bottom recess 48 of each of the pieces of the second row over the top extension 46 of each of the pieces of the first row and following the procedure used for installing the first row, and all remaining rows 50 are installed by continuing as for the second row. Each of the pieces 40 and 54 is fastened to the wall 25 by fasteners 400.

The siding is installed on all remaining walls by following the procedures used on the first two walls, alternating walls on which the bottom row of siding is formed of longitudinally split pieces.

Lastly, the pointed corner pieces 300 are installed. At the first intersecting corner 30, a pointed corner piece 300 is split longitudinally and one of the split pointed corner pieces is placed adjacent to and abutting the foundation 20 of the second wall 25 at the first intersecting corner 30 so that the apex 326 of said split pointed corner piece 300 meets the junction between the first tabbed corner piece 200 and the foundation 20. Then the split pointed corner piece 300 is fastened to the first tabbed corner piece 200 and adjacent first siding piece 40 with fasteners 400. Caulking will be used by those skilled in the art during installation of the pointed corner pieces 300 to minimize moisture contact with the inner faces 322 and 324 of the corner pieces 300. The exterior convex surface 330 of each of the pointed corner pieces 300 extends the outer circumferential surface of a previously placed siding piece 40.

Then a pointed corner piece 300 is installed at the foundation 20 of the third wall 25 at the second intersecting corner 30 so that the apex 326 of the pointed corner piece 300 meets the junction between the first tabbed corner piece and the next highest tabbed corner piece 200 and fastening said pointed corner piece 300 to each of the adjacent tabbed corner pieces 200 and straight end pieces 40 with fasteners 400 as necessary.

Then the placement of the first row of pointed corner pieces is completed by placing pointed corner pieces 300 at the foundation 20 of all remaining walls 25 according to the procedures used at the first and second intersecting corners 30.

Finally, pointed corner pieces 300 are stacked on top of the first pointed corner piece at each intersecting corner 30 until the stacked pointed corner pieces 300 reach the top of each wall 25; each pointed corner piece 300 is fastened to each tabbed corner piece 200 and straight end piece 40 with fasteners 400 as necessary.

Advantages of the Invention

My invention has provided a means for fabricating and erecting building siding which has the look of traditional log construction without the cost or drawbacks of using full logs. Fabrication of the detached log ends is simpler than detached log end systems of "same look" siding. My left hand or right hand system reduces the number of pointed end siding pieces needed on a project by fifty percent over other systems. My log siding gives the look of traditional log construction on any new or existing building. Dimensions of the logs used are small enough that the wood can be kiln dried prior to construction, reducing shrinkage and making the wood lighter and easier to handle than convention "half log" siding, and leading to lower shipping and installation costs.

Caulking will be used by those skilled in the art during installation of the corner pieces to minimize moisture contact with the inner faces of the corner pieces.

The siding can be installed with an ordinary circular saw; no special tools are required for use in the field. The siding and corner pieces can be fabricated in any woodworking plant. The corner pieces can be manufactured from pieces that are presently considered waste at most log mills.

If corner pieces with splines 110 and grooves 112 are used, accurate placement of corner pieces 100 on top of each other is made easier and quicker. If corner pieces with circular tops 114 and recessed bottom surfaces 116 are used, a smoother and more aesthetically pleasing finished corner is obtained.

My siding can be used at an installed cost which is competitive with other sidings of similar quality and character.

Alternatives Within Invention

Although the present invention has been described in considerable detail with reference to certain preferred versions thereof, other versions are possible. For example, the siding pieces 40 and 54 may be made without top extensions 46 and bottom recesses 48 without departing from the teachings of my invention. Another example is use of the siding and corner pieces on gables and dormers, where the end pieces intersect with a sloping roof. Although I have described in detail the method of installing the siding from the bottom up, the teachings of my invention are equally applicable to top down construction. And although I have depicted four alternate embodiments of the top and bottom surfaces of the corner pieces 100, others within the teachings of my invention will be apparent to persons skilled in the art. Numerous characteristics and advantages of the invention covered by this document have been set forth in the foregoing description. It will be understood that other forms of the full corner log siding are contemplated by the present invention and that numerous modifications may be made by those with skill in the art without departing from the spirit and scope of the invention defined by the appended claims.

I claim:

1. Full corner log siding comprising log siding and corner pieces cooperating therewith for use on a structure having intersecting walls, comprising a. substantially round corner pieces having outer and inner ends, comprising tabbed corner pieces and pointed corner pieces, (1) each tabbed corner piece being generally L-shaped, having a substantially round outer end, having an inner end which comprises a substantially cylindrical segment of the tabbed corner piece, said cylindrical segment having a length and a thickness, forming a 90-degree angle internal corner to abut and fit snugly against the external corner of a wall of the structure, and having a flat surface at its inner end, said tabbed corner piece being fastenable to the intersecting walls, and (2) each pointed corner piece having concave arcs at its inner end to abut and fit snugly against the round surfaces of adjacent tabbed corner pieces, and being fastenable to the tabbed corner pieces, b. siding end pieces with rounded external surfaces, said siding end pieces having a thickness equal to that of the inner end of the tabbed corner pieces, and comprising straight end pieces and fitted end pieces, (1) each straight end piece having an end perpendicular to the length of the piece to abut and fit snugly against the flat surface at the inner end of the tabbed corner piece, and being fastenable to an adjacent wall, and (2) each fitted end piece having concave arcs at one end to abut and fit snugly against the round surfaces of adjacent tabbed corner pieces and being fastenable to an adjacent wall.

2. Full corner log siding comprising log siding and corner pieces cooperating therewith for use on a structure having a foundation and four or more walls, the walls meeting perpendicularly at four or more intersecting corners, and the four or more walls resting upon the foundation, wherein a. said log siding being comprised of rows, a first row to abut the foundation and additional rows to extend upward therefrom, each of said rows comprising one straight end and one fitted end;

b. each of said rows comprising one or more pieces and each of said one or more pieces comprising a cylindrical segment of a pre-determined radius, having a width, a height, a length, a top extension, a bottom recess, an inner face along the chord of said cylindrical segment, and an imaginary center plane along the length of the piece and perpendicular to said inner face, c. the inner face of each piece to abut and be fastenable to one of the four or more walls, (1) the bottom recess of each piece of the first row to abut the foundation of the structure, and (2) the bottom recess of each piece of every row other than the first row to overlap the top extension of the next lower piece;

d. the straight end of each row comprising a piece with ends substantially perpendicular to the length of said piece;

e. the fitted end of each row comprising a piece having an inner end and a pointed end, (1) the inner end being perpendicular to the length of said piece and (2) the pointed end comprising two concave cylindrical surfaces, an upper concave cylindrical surface and a lower concave cylindrical surface, the radius of each of said upper and lower concave cylindrical surfaces being equal to the radius of said piece, each of said upper and lower concave cylindrical surfaces having a height of half the height of the piece, having a maximum width equal to the width of the piece, and the upper concave cylindrical surface being perpendicular to the top of the cylindrical segment and the lower concave cylindrical surface being perpendicular to the bottom of the cylindrical segment and said upper and lower concave cylindrical surfaces forming an apex at the imaginary center plane of said piece;

f. each of said corner pieces comprising a substantially cylindrical log of the same radius as that of a siding piece, having a centerline, having an imaginary center plane passing through the centerline and being substantially horizontal, and having a top plane along a chord thereof at a distance of half the height of a siding piece above said imaginary center plane of said corner piece, said top plane being substantially horizontal and having a length parallel to the centerline of the corner piece and having a width perpendicular to the length, and having a bottom plane parallel to said top plane at a distance of half the height of a siding piece below said imaginary center plane of said corner piece, said bottom plane having a length parallel to the centerline of the corner piece and having a width perpendicular to the length;

g. the bottom plane of the first corner piece to abut the foundation of the structure and the bottom plane of each corner piece other than the first corner piece to abut the top plane of the next lower corner piece;

h. each of said corner pieces to extend outwardly from one of the four or more intersecting corners of the structure in either a first direction or a second direction, the first direction to extend the line of one of the four or more walls and the second direction to be perpendicular to the first direction;

i. the corner pieces comprising tabbed corner pieces and pointed corner pieces;

j. each of said tabbed corner pieces comprising a top plane, a bottom plane, a distal face, an inner end, a length between the distal face and the inner end, an exterior convex surface to form a 180-degree angle with an adjacent wall, and an interior convex surface to form a 90-degree angle with a second, adjacent, wall, (1) said distal face being substantially perpendicular to the length of said tabbed corner piece, (2) said inner end comprising three planes, a first plane, a second plane, and a third plane, (a) the first plane being perpendicular to the length of said tabbed corner piece and comprising a circular segment of the same radius as that of a siding piece, having width equal to the width of a siding piece, and having height equal to the height of a siding piece, (b) the second plane being a rectangle perpendicular to said first plane and having a width equal to the height of a siding piece and having a length less than the width of the top and bottom planes of the adjacent pointed corner pieces, (c) the third plane being perpendicular to said second plane, and (d) the distance between said distal face and said first plane of said inner end being greater than the distance between said distal face and said third plane of said inner end, (3) the interior convex surface of said tabbed corner piece to abut (a) the upper concave cylindrical surface of the fitted end of one row and (b) the lower concave cylindrical surface of the fitted end of the next higher row, and (4) said first plane of said inner end of said tabbed corner piece to abut the straight end of one row, said second plane of said inner end of said tabbed corner piece to abut one of the four or more walls at one of the four or more intersecting corners, and said third plane of said inner end of said tabbed corner piece to abut the wall which intersects said one wall at said intersecting corner, and said tabbed corner piece to be fastenable to said walls; and k. each of said pointed corner pieces comprising a top plane, a bottom plane, a distal face, a pointed end, a length between the distal face and the pointed end, an exterior convex surface to form a 180-degree angle with an adjacent wall, and an interior convex surface to form a 90-degree angle with an adjacent wall, (1) said distal face being substantially perpendicular to the length of said pointed corner piece, (2) said pointed end comprising two concave cylindrical surfaces, an upper concave cylindrical surface and a lower concave cylindrical surface, (a) the radius of each of said upper and lower concave cylindrical surfaces being equal to the radius of said pointed corner piece, (b) each of said upper and lower concave cylindrical surfaces having a height equal to half the height of a siding piece and a maximum width equal to the width of a pointed corner piece, (c) the upper concave cylindrical surface being perpendicular to the top plane of the pointed corner piece, (d) the lower concave cylindrical surface being perpendicular to the bottom plane of the pointed corner piece, (e) said upper and lower concave cylindrical surfaces forming an apex at the imaginary center plane of said pointed corner piece, and (3) said lower concave cylindrical surface to abut the exterior convex surface of one of the tabbed corner pieces, said upper concave cylindrical surface to abut the exterior convex surface of the next higher tabbed corner piece, and said pointed corner piece to be fastenable to the adjacent tabbed corner pieces and siding pieces.

3. The full corner log siding of claim 2 with each corner piece comprising a. spline the length of the top plane and extending upward from said top plane of the corner piece, and b. a groove the length of the bottom plane and mirroring the spline of the top plane, said groove extending inward from said bottom plane.

4. A method for using the full corner log siding of claim 2, comprising a. placing a first tabbed corner piece at the foundation of a first wall at a first intersecting corner with a second wall and fastening said first tabbed corner piece to said walls at said first intersecting corner, b. splitting a tabbed corner piece longitudinally and placing one of said split tabbed corner pieces at the foundation of the second wall at a second intersecting corner with a third wall as a first split tabbed corner piece at said next intersecting corner and fastening said first split tabbed corner piece to the intersecting walls at said second intersecting corner, c. placing a first tabbed corner piece at the foundation of the third wall at a third intersecting corner with a fourth wall and fastening said first tabbed corner piece to said intersecting walls at said third intersecting corner, d. splitting a tabbed corner piece longitudinally and placing one of said split tabbed corner pieces at the foundation of the fourth wall at the fourth intersecting corner with an intersecting wall as a first split tabbed corner piece and fastening said first split tabbed corner piece to the intersecting walls at said fourth intersecting corner, e. completing the placement of tabbed corner pieces at the foundation of any additional walls at any additional intersecting corners and fastening said tabbed corner pieces to said walls by following the above procedures, f. stacking tabbed corner pieces on top of the first tabbed corner piece at each intersecting corner until the stacked tabbed corner pieces reach the top of each wall and fastening each tabbed corner piece to the wall, g. installing a row of siding on the first wall by (1) placing a fitted end piece adjacent to and abutting the foundation of said wall and adjacent to the first tabbed corner pieces so that the apex of the fitted end piece meets the junction between the first tabbed corner piece and the next highest tabbed corner piece, (2) placing pieces having straight ends adjacent to and abutting the foundation of said wall to fill the space between the straight end of the fitted end piece and the first plane of the inner end of the first tabbed corner piece at the next intersecting corner, and (3) fastening said pieces of siding to said first wall, h. installing a second row of siding on said first wall by fitting the bottom recesses of each of the pieces of the second row over the top extension of each of the pieces of the first row and following the procedure used for installing the first row, i. installing all remaining rows of siding on said first wall by continuing as for the second row, j. installing a first row of siding on the second wall by (1) splitting a fitted end piece longitudinally and placing one of said split end pieces adjacent to and abutting the foundation of said wall and adjacent to the first tabbed corner piece so that the apex of the split fitted end piece meets the junction between the first tabbed corner piece and the foundation, (2) splitting a straight end piece and placing said split straight end pieces adjacent to and abutting the foundation of said wall to fill the length between the straight end of the fitted end piece and the first plane of the inner end of the tabbed corner piece at the next intersecting corner, and (3) fastening said pieces of siding to said wall, k. installing a second row of siding on said second wall by fitting the bottom recess of each of the pieces of the second row over the top extension of each of the pieces of the first row and following the procedure used for installing the first row, l. installing all remaining rows of siding on said second wall by continuing as for the second row, m. installing all rows of siding on all remaining walls by following the procedures used for the first and second walls, n. splitting a pointed corner piece longitudinally and placing one of said split pointed corner pieces adjacent to and abutting the foundation of the second wall at the first intersecting corner so that the apex of said split pointed corner piece meets the junction between the first tabbed corner piece and the foundation and fastening said split pointed corner piece to said first tabbed corner piece and its adjacent siding piece, o. placing a pointed corner piece at the foundation of the third wall at the second intersecting corner so that the apex of said pointed corner piece meets the junction between the first tabbed corner piece and the next highest tabbed corner piece and fastening said pointed corner piece to each of the adjacent tabbed corner pieces and siding pieces, p. completing the placement of pointed corner pieces adjacent to the foundation of all additional walls at all additional intersecting corners and fastening said pointed corner pieces to their adjacent tabbed corner pieces and siding pieces according to the procedures used at the first and second intersecting corners, and q. stacking pointed corner pieces on top of the first pointed corner piece at each intersecting corner until the stacked pointed corner pieces reach the top of each wall, and fastening each pointed corner piece to its adjacent tabbed corner pieces and siding pieces.

* * * * *